US009366994B2

(12) United States Patent
Shinohara et al.

(10) Patent No.: US 9,366,994 B2
(45) Date of Patent: Jun. 14, 2016

(54) DEVELOPER CONTAINER, CARTRIDGE, AND IMAGE FORMING APPARATUS

(71) Applicant: CANON KABUSHIKI KAISHA, Tokyo (JP)

(72) Inventors: Seiichi Shinohara, Mishima (JP); Hiroki Ogino, Mishima (JP); Kojiro Yasui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/871,796

(22) Filed: Sep. 30, 2015

(65) Prior Publication Data

US 2016/0097993 A1 Apr. 7, 2016

(30) Foreign Application Priority Data

Oct. 2, 2014 (JP) ..... 2014-203555

(51) Int. Cl.
*G03G 15/08* (2006.01)

(52) U.S. Cl.
CPC ..... *G03G 15/0891* (2013.01)

(58) Field of Classification Search
CPC ..... G03G 15/0891
See application file for complete search history.

(56) References Cited

U.S. PATENT DOCUMENTS

| | | | | |
|---|---|---|---|---|
| 5,270,484 | A * | 12/1993 | Tsuchiya et al. | G03G 15/08 310/323.01 |
| 6,463,225 | B1 * | 10/2002 | Abe et al. | G03G 15/0856 399/254 |
| 2001/0004423 | A1 * | 6/2001 | Kakeshita et al. | G03G 21/1889 399/24 |
| 2002/0025195 | A1 * | 2/2002 | Iwata et al. | G03G 15/0875 399/258 |
| 2007/0286645 | A1 * | 12/2007 | Hayashi | G03G 15/0875 399/262 |

FOREIGN PATENT DOCUMENTS

| | | | |
|---|---|---|---|
| JP | H02-197881 | A | 8/1990 |
| JP | 2829938 | B2 | 12/1998 |
| JP | H11-174804 | A | 7/1999 |
| JP | 2002-196585 | A | 7/2002 |
| JP | 2006-058756 | A | 3/2006 |

* cited by examiner

*Primary Examiner* — G. M. Hyder
(74) *Attorney, Agent, or Firm* — Canon U.S.A., Inc. IP Division

(57) ABSTRACT

A developer container configured to contain developer to be used for image formation, includes a first electrode provided in the developer container, a second electrode provided opposing to the first electrode configured to detect an electrostatic capacitance between the first electrode and the second electrode, to detect a quantity of the developer, a conveyance member provided between the first electrode and the second electrode and on a bottom surface side inside the developer container, and configured to convey the developer contained in the developer container, and a vibration imparting member configured to impart vibration to the conveyance member, wherein the developer on a developer conveyance surface of the conveyance member contacting the developer is conveyed by the vibration of the conveyance member.

14 Claims, 9 Drawing Sheets

DEVELOPER CONTAINER, CARTRIDGE, AND IMAGE FORMING APPARATUS

BACKGROUND OF THE INVENTION

1. Field of the Invention

The present invention relates to a developer container that contains developer to be used for image formation, a cartridge, which includes the developer container and is attachable to and detachable from an image forming apparatus, and an image forming apparatus that includes the cartridge.

Here, examples of the "image forming apparatus" include an electrophotographic copy machine, an electrophotographic printer (e.g., a light emitting diode (LED) printer, a laser beam printer), and an electrophotographic facsimile apparatus that form an image on a recording medium by using an electrophotographic image forming process.

Further, the term "cartridge" refers to a unit in which at least a developer container and a developer bearing member are integrally configured, and is attachable to and detachable from an image forming apparatus main body, or a unit in which a developer container, a developer bearing member, and at least an image bearing member are integrally configured, and is attachable to and detachable from an image forming apparatus main body.

Still further, the developer container is housed in the image forming apparatus or the cartridge.

2. Description of the Related Art

Conventionally, as discussed in Japanese Patent Application Laid-Open No. 2002-196585, inside a container that contains developer, which is attachable to and detachable from an image forming apparatus, an agitation conveyance member that conveys developer contained therein toward a developing roller while agitating the developer is provided. In the configuration discussed in Japanese Patent Application Laid-Open No. 2002-196585, a plurality of the agitation conveyance members are used.

Further, as a means for detecting the quantity of developer conveyed in the developer container, as discussed in Japanese Patent Application Laid-Open No. 2-197881, electrodes are provided on an agitation conveyance member that rotates and another part, a value of an electric signal based on an electrostatic capacitance between the electrodes is detected, whereby the quantity of developer is detected. Other configurations have been discussed also in Japanese Patent Application Laid-Open No. 11-174804, and Japanese Patent Application Laid-Open No. 2006-58756.

In the above-described configuration in which developer is conveyed as discussed in Japanese Patent Application Laid-Open No. 2002-196585, however, the agitation conveyance member can convey only the developer located within the rotation radius, and hence, the bottom surface of the container needs to be formed in an arc shape in a cross sectional view. Therefore, a projected portion needs to be formed in a region of a floor surface of the container which the agitation conveyance member cannot reach, so that the developer does not stay in the region of the projected portion. Therefore, this projected portion in the container becomes a dead space.

Further, in the configuration discussed in Japanese Patent Application Laid-Open No. 2-197881, in which the quantity of developer is detected, an electric signal that changes in accordance with the rotation action of the agitation conveyance member is detected. Therefore, the electric signal significantly varies with the presence state of the developer, which causes the detection result to vary significantly.

SUMMARY OF THE INVENTION

The present invention is directed to a technique capable of reducing a dead space in a conveyance path for conveying developer as compared with conventional ones, and detecting the quantity of conveyed developer with high accuracy.

According to an aspect of the present invention, a developer container configured to contain developer to be used for image formation, includes a first electrode provided in the developer container, a second electrode provided opposing to the first electrode configured to detect an electrostatic capacitance between the first electrode and the second electrode, to detect a quantity of the developer, a conveyance member provided between the first electrode and the second electrode and on a bottom surface side inside the developer container, and configured to convey the developer contained in the developer container, and a vibration imparting member configured to impart vibration to the conveyance member, wherein the developer on a developer conveyance surface of the conveyance member contacting the developer is conveyed by the vibration of the conveyance member.

Further features of the present invention will become apparent from the following description of exemplary embodiments with reference to the attached drawings.

DESCRIPTION OF THE EMBODIMENTS

Exemplary embodiments of the present invention will be described in detail with reference to the drawings. The sizes, materials, shapes, relative arrangements, and the like of the configuration components of the exemplary embodiments described herein are not intended to limit the scope of the present invention, unless otherwise described. Further, the materials, shapes, and the like of the members described in the following description once are the same as those that are described first, unless otherwise described.

(Overall Configuration of Image Forming Apparatus)

Figure 1:
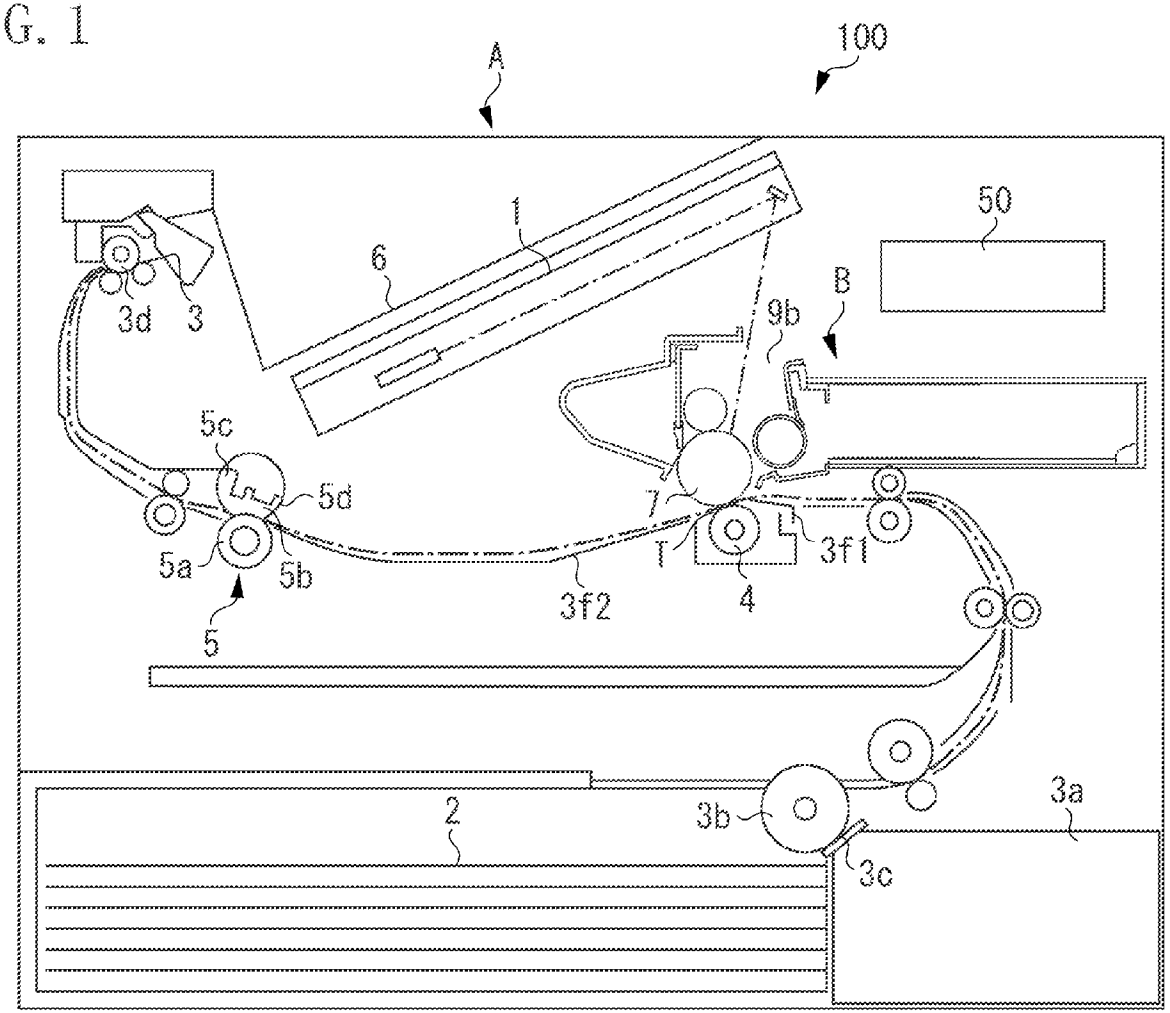
FIG. 1 is a cross-sectional view illustrating an image forming apparatus according to a first exemplary embodiment of the present invention.

First of all, an overall configuration of an electrophotographic image forming apparatus 100 (hereinafter referred to as "image forming apparatus 100") is described schematically with reference to FIG. 1. FIG. 1 is a schematic cross-sectional view illustrating the image forming apparatus 100 according to s first exemplary embodiment in which a cartridge B is mounted. More specifically, FIG. 1 is a schematic cross-sectional view illustrating a laser beam printer as an example of the image forming apparatus 100.

As illustrated in FIG. 1, the image forming apparatus 100 (laser beam printer) includes an apparatus main body A for image formation, and a cartridge B that is attachable to and detachable from the apparatus main body A. Inside the cartridge B, which is mounted inside the apparatus main body A, a photosensitive drum 7 is provided.

Further, the image forming apparatus 100 projects information light according to image information from an exposure device 1 as an exposure unit to the photosensitive drum 7, thereby forming an electrostatic latent image on the photosensitive drum 7. This electrostatic latent image is developed with developer (hereinafter referred to as "toner"), whereby a toner image is formed. In synchronization with the formation of the toner image, a recording medium (e.g., a recording sheet, an overhead projector (OHP) sheet, a cloth) 2 is separated and fed one by one from a cassette 3*a* by a pickup roller 3*b* and a pressure contact member 3*c* that is pressed against the pickup roller 3*b*.

The fed recording medium 2 is conveyed along a convey guide 3*f*1 to a transfer portion T where the photosensitive drum 7 of the cartridge B and a transfer roller 4 as a transfer unit are opposed to each other. To the recording medium 2 thus conveyed to the transfer portion T, the toner image formed on the photosensitive drum 7 is transferred by the transfer roller 4 to which a voltage is applied, and is conveyed along a convey guide 3*f*2 to a fixing device 5.

The fixing device 5 is composed of a drive roller 5*a*, and a fixing rotation member 5*d* that incorporates a heater 5*b* and is formed with a cylindrical sheet that is rotatably supported by a supporting member 5*c*. The fixing device 5 fixes the transferred toner image onto a recording medium 2 passing therethrough, by applying heat and pressure.

The discharge roller 3*d* is configured to convey the recording medium 2 on which the toner image is fixed, and to discharge the recording medium 2 to a discharge unit via a reversing conveyance path. In the present exemplary embodiment, the pickup roller 3*b*, the pressure contact member 3*c*, the discharge roller 3*d*, and the like configure a conveyance device 3.

A controller 50 controls the driving of the apparatus main body A and the cartridge B, and the electrical system.

(Cartridge)

Figure 2:
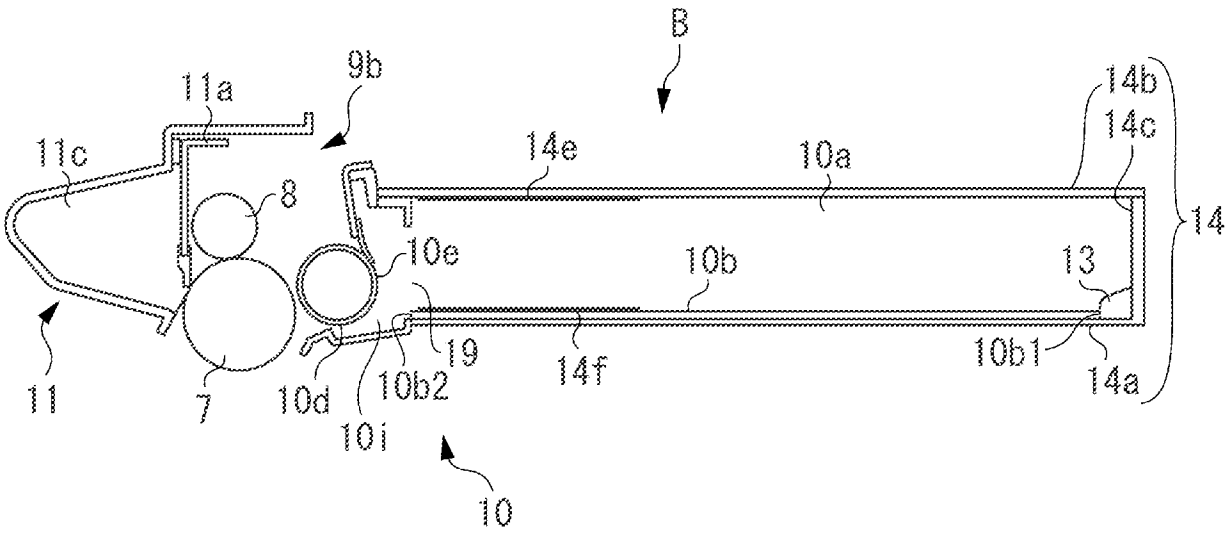
FIG. 2 is a cross-sectional view illustrating a cartridge according to the first exemplary embodiment.

Next, an overall configuration of the cartridge B (process cartridge) is described schematically with reference to FIG. 2. FIG. 2 is a schematic cross-sectional view of the cartridge B.

As illustrated in FIG. 2, the cartridge B includes the photosensitive drum 7 as an "image bearing member" for bearing a developer image, and at least one process unit. In the present exemplary embodiment, examples of the process unit include a charging unit for charging the photosensitive drum 7, a developing unit for developing an electrostatic latent image formed on the photosensitive drum 7, and a cleaning unit for cleaning toner remaining on the photosensitive drum 7.

The cartridge B rotates the photosensitive drum 7 having a photosensitive layer, and applies a voltage to a charging roller 8 as a charging unit, thereby uniformly charging the surface of the photosensitive drum 7. The photosensitive drum 7 thus charged is exposed to information light (light image) projected from the exposure device 1 according to the image information via an exposure opening 9*b*, so that an electrostatic latent image is formed on the surface of the photosensitive drum 7. Then, this electrostatic latent image is developed by a development unit 10. The development unit 10 is a developing device.

In the development unit 10, toner is contained in a toner containing portion 10*a* formed with a container body 14*a* and a container lid 14*b* of a toner container 14 as a "developer container". A developer conveyance member (hereinafter referred to as a "conveyance member") 10*b* feeds out the toner in the toner containing portion 10*a* via an opening portion 19 in a direction toward the developing chamber 10*i*.

Then, the development unit 10 rotates a developing roller 10*d* as a "developer bearing member" bearing developer. With this rotation, a developing blade 10*e* causes toner, to which friction charges are given, to bear on a surface of the developing roller 10*d*, and the toner is caused to be transferred to the photosensitive drum 7 according to the electrostatic latent image, whereby a toner image is formed and visualized.

Then, a voltage having a polarity opposite to that of the toner image is applied to the transfer roller 4 so that the toner image is transferred to the recording medium 2. Thereafter, toner remaining on the photosensitive drum 7 is scraped off by a cleaning blade 11*a* arranged in the drum unit 11, and is collected in a removed toner containing portion 11*c*. With these cleaning units, toner remaining on the photosensitive drum 7 is removed.

The cartridge B includes a drum unit 11 that rotatably supports the photosensitive drum 7 and incorporates the cleaning blade 11*a* and the charging roller 8. The cartridge B further includes the development unit that incorporates the developing roller 10*d* and the toner containing portion 10*a*. The cartridge B includes the drum unit 11 and the development unit 10.

(Toner Conveyance Configuration of Toner Containing Portion)

Next, a toner conveyance configuration of the toner containing portion is described more specifically, with reference to FIGS. 1 to 3B. In the present exemplary embodiment, the toner containing portion includes the toner container 14, the conveyance member 10*b*, and a vibration member 13.

Figure 3A:
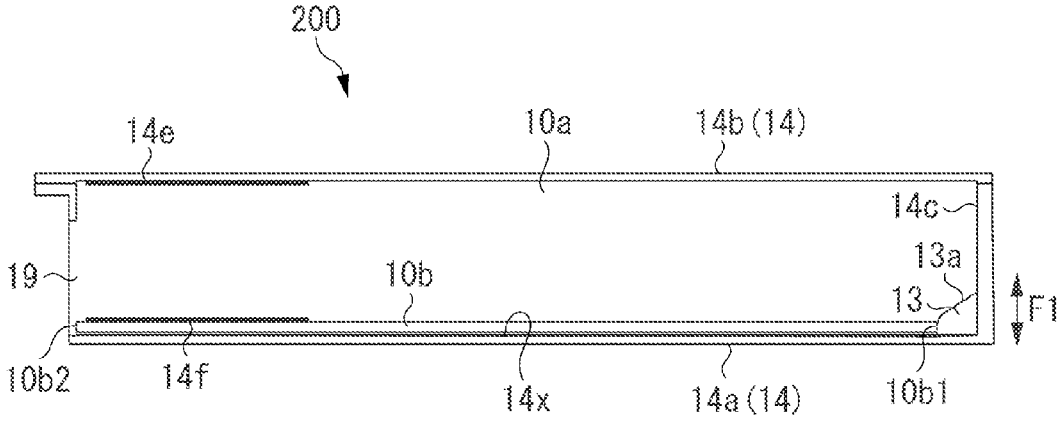
FIG. 3A is a cross-sectional view illustrating a developer conveyance mechanism according to the first exemplary embodiment.
Figure 3B:
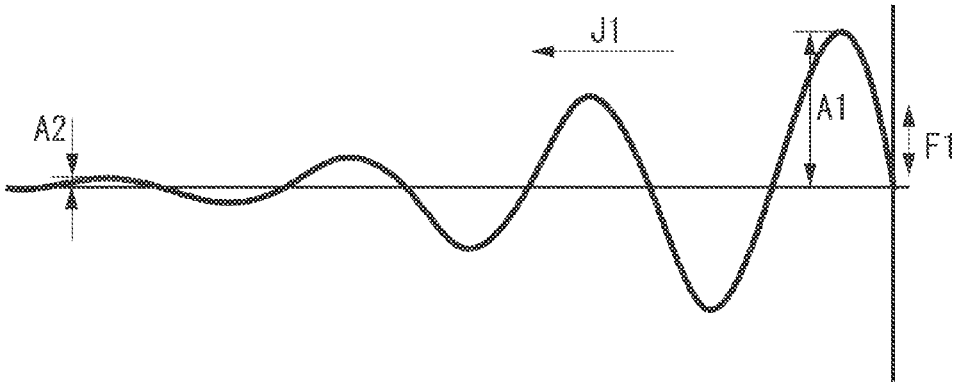
FIG. 3B is a waveform diagram of a traveling wave.

FIG. 3A is a cross-sectional view illustrating a developer conveyance mechanism 200, and FIG. 3B is a waveform diagram of a traveling wave. As illustrated in FIG. 3A, the developer conveyance mechanism 200 includes the toner container 14 that contains toner. The toner container 14 includes the container body 14*a* and the container lid 14*b*. When the container lid 14*b* is mounted on the container body 14*a*, the opening portion 19 is formed. Further, when the cartridge B is loaded in the apparatus main body A, a floor surface 14*x* of the container body 14*a* becomes approximately horizontal. The opening portion 19 is an opening through which the toner inside the toner container 14 is supplied to the developing roller 10*d* (see FIG. 2).

Next, the conveyance member 10*b* is described. The conveyance member 10*b* is a plate-like member that is arranged under the toner so as to convey the toner. The conveyance member 10*b* is arranged on a bottom surface side of the inside of the toner container 14. In the present exemplary embodiment, the conveyance member 10*b* is arranged on a floor surface 14*x* of the toner container 14. The conveyance member 10*b* is configured in such a manner that at least one part thereof is fixed to the vibration member 13. A traveling wave, caused by the vibration member 13 as a generation source, is generated in the conveyance member 10*b* (traveling wave generation step), and this causes the developer to be conveyed in a conveyance direction J1 as a "developer conveyance direction" (developer conveyance step). This conveyance direction J1 can be described as a traveling direction of the traveling wave.

The configuration of the developer conveyance mechanism 200 is such that the conveyance member 10*b* placed on the floor surface 14*x* of the toner container 14 is vibrated, which is different from the configuration in which the toner container 14 is directly vibrated or swung. This is because, in the configuration where the toner container 14 is vibrated or swung, a mechanism for vibrating or swinging the toner container 14 is required outside the toner container 14, and therefore, a space for the mechanism is required. Such additional mechanism and space are redundant. Further, if the toner container 14 is directly vibrated or swung, errors may occur in the position accuracy of the developing roller 10*d* assembled in the toner container 14, which adversely influences image formation. The configuration of the present exemplary embodiment is also intended to avoid such a situation.

In the conveyance member 10*b*, an edge thereof on the downstream side in the conveyance direction J1 is referred to an edge portion 10*b*2, and an edge (base edge) thereof on the upstream side in the conveyance direction J1 is referred to a fixed portion 10*b*1. The fixed portion 10*b*1 is a fixed edge that is fixed to the vibration member 13 that transmit vibration to the conveyance member 10*b*. The edge portion 10*b*2 is not fixed to the floor surface 14*x*, and therefore, is a free edge.

Further, the conveyance member 10*b* is formed with a polyethylene terephthalate (PET) sheet having a thickness of 300 μm, but the material is not limited to this. The conveyance member 10*b* may be made of a common elastomer material such as silicone rubber, acrylic rubber, natural rubber, or butyl rubber. Further, the conveyance member 10*b* may be appropriately formed with a common plastic material such as polystyrene (PS), polyethylene (PE), polypropylene (PP), ABS resin, polycarbonate (PC), or polyacetal (POM).

Next, the vibration member 13 is described. The vibration member 13 is a vibration imparting member that vibrates so as to give a reciprocating acceleration to the conveyance member 10*b* in an orthogonal direction F1 that is orthogonal to a toner conveyance surface as a "developer conveyance surface". The vibration member 13 is arranged on the upstream side of the conveyance member 10*b* in the conveyance direction J1.

When the vibration member 13 vibrates in the orthogonal direction F1 orthogonal to the conveyance direction J1 of the conveyance member 10*b*, the vibration of the vibration member 13 is transmitted via the fixed portion 10*b*1 to the conveyance member 10*b*, and causes the conveyance member 10*b* to vibrate in the toner containing portion 10*a*. Here, the vibration frequency is set to 40 Hz, and the vibration amplitude is set to about 0.8 mm. The vibration member 13 is arranged in the vicinity of a rear edge portion 14*c* on the side opposite to the opening portion 19 of the toner container 14, and an inclined surface portion 13*a* is formed on an upper part of the vibration member 13.

The vibration member 13 is composed of a common vibration exciter body that is capable of generating vibration, such as a piezoelectric element, or a vibration member that is vibrated by a vibration exciter.

As illustrated in FIGS. 3A and 3B, when the vibration member 13 vibrates, the fixed portion 10*b*1 of the conveyance member 10*b* makes a reciprocal movement in the orthogonal direction F1 with respect to the conveyance member 10*b*, and vibration is transmitted from the fixed portion 10*b*1 of the conveyance member 10*b* to the edge portion 10*b*2 thereof. At that time, the maximum vibration amplitude A1 of the conveyance member 10*b* on the fixed portion 10*b*1 side, caused by the vibration of the vibration member 13, is greater than the maximum vibration amplitude A2 of the conveyance member 10*b* on the edge portion 10*b*2 side (A1>A2). This is because the vibration amplitude given by the vibration member 13 to the conveyance member 10*b* is attenuated by absorption of vibration by the conveyance member 10*b* itself. This generates such a traveling wave that peak and bottom portions of the conveyance member 10*b* move from the side of the fixed portion 10*b*1 of the conveyance member 10*b* to the side of the edge portion 10*b*2 thereof.

Some toner existing on an inclined surface part of the traveling wave cannot stay on the inclined surface, and falls into a bottom part of the traveling wave. At that time, as the bottom part moves along with the traveling wave, the repetition of this action makes it possible to convey toner in the same direction as that of the traveling wave.

Toner on the conveyance member 10*b*, therefore, is conveyed in the direction J1 (conveyance direction) toward the side of the opening portion 19 of the toner container 14, by the traveling wave that travels from the fixed portion 10*b*1 toward the edge portion 10*b*2.

In a case where the vibration frequency is a high frequency of 50 kHz or the like, as discussed in Japanese Patent No. 2829938, it is known that toner moves in a direction opposite to that of the traveling wave. As is the case with the present exemplary embodiment, however, in the region of a low frequency (e.g., 40 Hz as described above), this conveyance mechanism is not applied, and toner moves in the direction of the traveling wave (the conveyance direction J1), according to the above-described mechanism.

Further, on the upper part of the vibration member 13, the inclined surface portion 13*a* is provided. Toner on the vibration member 13, therefore, slips over the inclined surface portion 13*a* as the vibration member 13 vibrates, and thereby can reach the conveyance member 10*b*. In this way, toner is prevented from remaining on the vibration member 13.

(Configuration for Detecting Toner Quantity in Toner Containing Portion)

Figure 4:
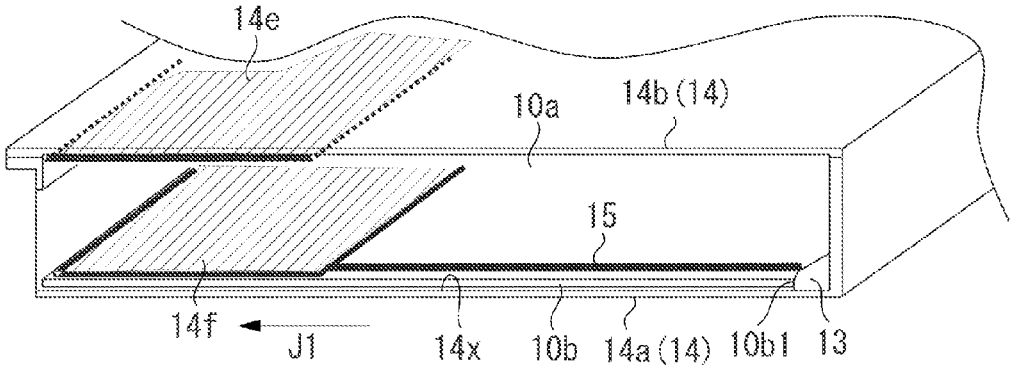
FIG. 4 is a perspective view of a cross section of a developer quantity detection mechanism according to the first exemplary embodiment.

Next, a configuration for detecting toner quantity in the toner containing portion is described in more detail, with reference to a perspective view of a cross section of the toner containing portion illustrated in FIG. 4. In the present exemplary embodiment, a toner remaining quantity detection mechanism of an electrostatic capacitance type is used, in which an electrostatic capacitance between electrodes is detected to detect a toner quantity. In this electrostatic capacitance detection method, an electrostatic capacitance between electrodes, which varies with a toner quantity and a toner density state, is detected.

In the toner containing portion 10*a* illustrated in FIG. 4, the toner container 14 includes the container body 14*a* and the container lid 14*b*. Further, the conveyance member 10*b* for conveying toner is arranged on the floor surface 14*x* of the container body 14*a*.

In the vicinity of the opening portion 19 (on the opening side), which is on the downstream side of the container lid 14*b* in the toner conveyance direction J1, a first electrode 14*e* is provided. This first electrode 14*e* is provided with a conductive path (not illustrated) that is led to the outside of the toner containing portion 10*a*, and is connected to the controller 50 of the image forming apparatus illustrated in FIG. 1.

On the other hand, on a surface of conveyance member 10*b* opposed to the first electrode 14*e*, there is provided a second electrode 14*f* for detecting an electrostatic capacitance between the second electrode 14*f* and the first electrode 14*e* so as to detect the quantity of the developer. The second electrode 14*f* is formed by forming a thin film conductive pattern on a surface of the conveyance member 10*b* by sputtering vapor deposition, and hence, does not disturb the movement of the traveling wave of the conveyance member 10*b*. The configuration of the second electrode 14*f* is not limited to the above-described configuration, as long as it is formed in a thin film form and does not disturb the movement of the conveyance member 10*b*. The second electrode 14*f* may be formed by, for example, applying a conductive paint.

Further, the second electrode 14*f* is provided with a conductive path 15 that is led via the fixed portion 10*b*1 of the conveyance member 10*b* to the outside of the toner containing portion 10*a*, and is connected to the controller 50 of the image forming apparatus illustrated in FIG. 1. The electrostatic capacitance between the first electrode 14*e* and the second electrode 14*f* is detected by the controller 50.

The second electrode 14*f* is desirably provided on a surface of the conveyance member 10*b* on the side contacting toner (on the developer conveyance surface). Toner is directly interposed between the first electrode 14*e* and the second electrode 14*f*, whereby when an electrostatic capacitance is detected, influences due to humidity change of the conveyance member 10*b* made of a resin material can be removed. Further, an influence of toner slipping into a space between the conveyance member 10*b* and the floor surface 14*x* can be removed, though such an influence is small.

Figure 5:
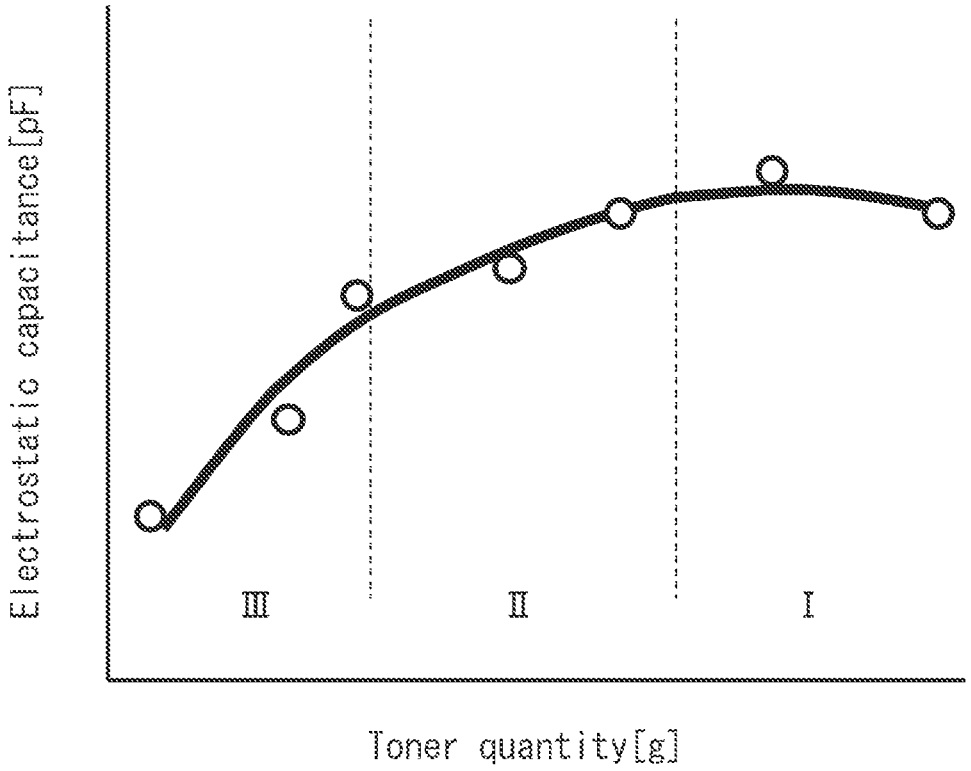
FIG. 5 is a graph illustrating electrostatic capacitance detection results according to the first exemplary embodiment.

As described above, the floor surface 14*x* of the toner container 14 in the present exemplary embodiment is provided to be approximately horizontal, and toner in the toner container 14 is conveyed in the horizontal direction as well. At the first electrode 14*e* and the second electrode 14*f* for detecting an electrostatic capacitance, the volume ratio of toner and air varies with the quantity of conveyed toner. In other words, the relationship between the quantity of toner and the electrostatic capacitance varies as illustrated in FIG. 5 to be described below (regions I, II, III). I: when a sufficient quantity of toner exists, toner is plentifully conveyed to a space between the first electrode 14*e* and the second electrode 14*f*, whereby a state of a high toner density is formed. II: when toner is consumed due to image formation, the quantity of toner conveyed to the space between the above-described electrodes decreases, whereby the toner density between the first electrode 14*e* and the second electrode 14*f* decreases. III: when the toner is nearly used up, the space interposed between the first electrode 14*e* and the second electrode 14*f* is filled with air alone. As toner and air have different relative dielectric constants, a change of the volume ratio between toner and air causes a change of the electrostatic capacitance. Detecting this electrostatic capacitance and determining variation thereof enables the quantity of remaining toner to be detected.

In the present exemplary embodiment, the toner conveyance in the toner containing portion 10*a* is performed only by an action of the conveyance member 10*b*, and the toner conveyance direction is a fixed one direction (conveyance direction J1). Therefore, the toner state in the toner container 14 is stable, which makes it possible to detect the quantity of toner with high accuracy.

FIG. 5 is a graph illustrating how the quantity of toner and the detected electrostatic capacitance change according to the present exemplary embodiment. With reference to the graph of FIG. 5, regions I to III are described, where in the region I, a sufficient quantity of toner exists; in the region II, the quantity of toner decreases, whereby the toner density decreases, and in the region III, toner is nearly used up.

In the region I, the toner density is increased due to toner conveyed thereto, and a stable and high electrostatic capacitance is detected. In the region II, the toner density also decreases as the quantity of toner decreases, which causes the electrostatic capacitance to gradually decrease. In the region III, as toner is used up, a further decrease in the electrostatic capacitance is detected.

The electrostatic capacitance is desirably detected when the toner conveyance member 10*b* is in a stationary state. For example, at an end of a print preparation operation of the image forming apparatus, or when toner conveyance is stopped after image formation is performed, an electrostatic capacitance is detected.

As described above, by using the toner container and the image forming apparatus according to the present exemplary embodiment, a dead space in the toner conveyance path can be reduced as compared with conventional ones. Further, the quantity of toner can be detected with high accuracy.

Now, a second exemplary embodiment of the present invention is described.

The configuration of the present exemplary embodiment is characterized in that at least a part of an internal space of the toner container 14 is gradually narrowed in the toner conveyance direction. As the toner conveyance configuration for the toner containing portion, the same one as that in the first exemplary embodiment is used in the present exemplary embodiment. With this configuration, the similar effect can be achieved in the toner conveyance operation.

Figure 6:
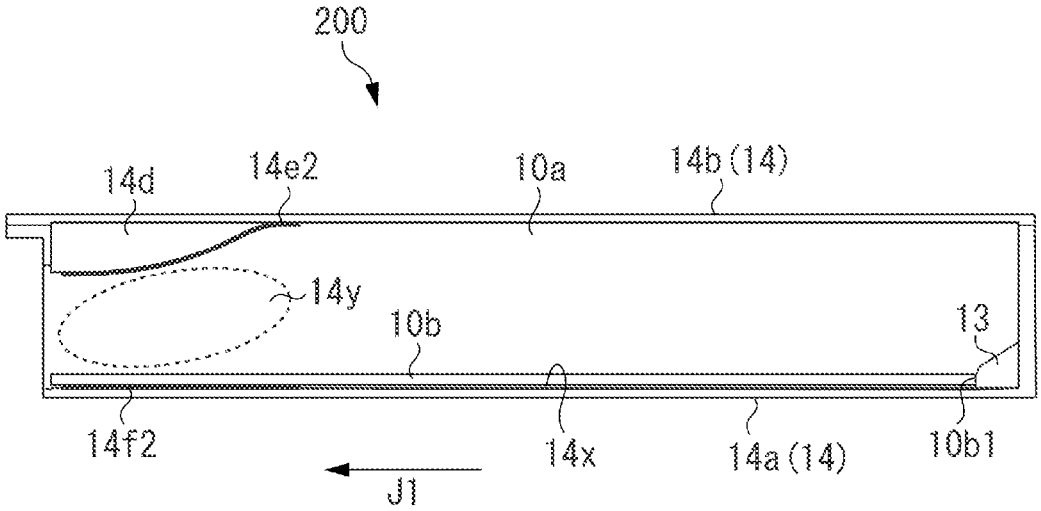
FIG. 6 is a cross-sectional view illustrating a developer quantity detection mechanism according to a second exemplary embodiment of the present invention.

FIG. 6 illustrates a configuration for detecting the quantity of toner in the toner containing portion 10*a* according to the present exemplary embodiment. In the toner remaining quantity detection mechanism according to the present exemplary embodiment, the same electrostatic capacitance method as that of the first exemplary embodiment described above is used.

In the container lid 14*b*, a narrow portion 14*d* is provided. In the narrow portion 14*d*, an internal space of the toner container 14 gradually narrowing along the toner conveyance direction J1, which is an approximately horizontal direction. With this narrow portion 14*d*, the distance of inside the toner container 14 in the direction orthogonal to the toner conveyance direction J1 of the conveyance member 10*b* is narrowed. This narrow portion 14*d* is intended to increase the toner density, without interrupting the conveyance of toner. For this purpose, the narrow portion 14*d* is desirably provided at a most downstream position in the conveyance direction J1 of the conveyance member 10*b*. Further, the configuration is desirably such that the narrow space 14*y* between the narrow portion 14*d* and the floor surface 14*x* includes a part of a conveyance region of the conveyance member 10*b*, and is gradually narrowed at least in the gravity direction. In the present exemplary embodiment, as illustrated in FIG. 6, the narrow portion 14*d* is provided on the side of the opening portion 19, i.e., on the opening side. Further, the narrow space 14*y* between the narrow portion 14*d* and the floor surface 14*x* is configured in such a manner that among faces thereof perpendicular to the toner conveyance direction J1, the face on the opening side has a smaller area than that of the other face.

In the narrow portion 14*d*, there is provided a first electrode 14*e*2 for detecting an electrostatic capacitance. On the other hand, on a floor surface 14*x* in the narrow space 14*y*, opposed to the first electrode 14*e*2, there is provided a second electrode 14*f*2. The first electrode 14*e*2 and the second electrode 14*f*2 are connected to the controller 50 of the image forming apparatus illustrated in FIG. 1, so as to detect an electrostatic capacitance between the electrodes.

Figure 7:
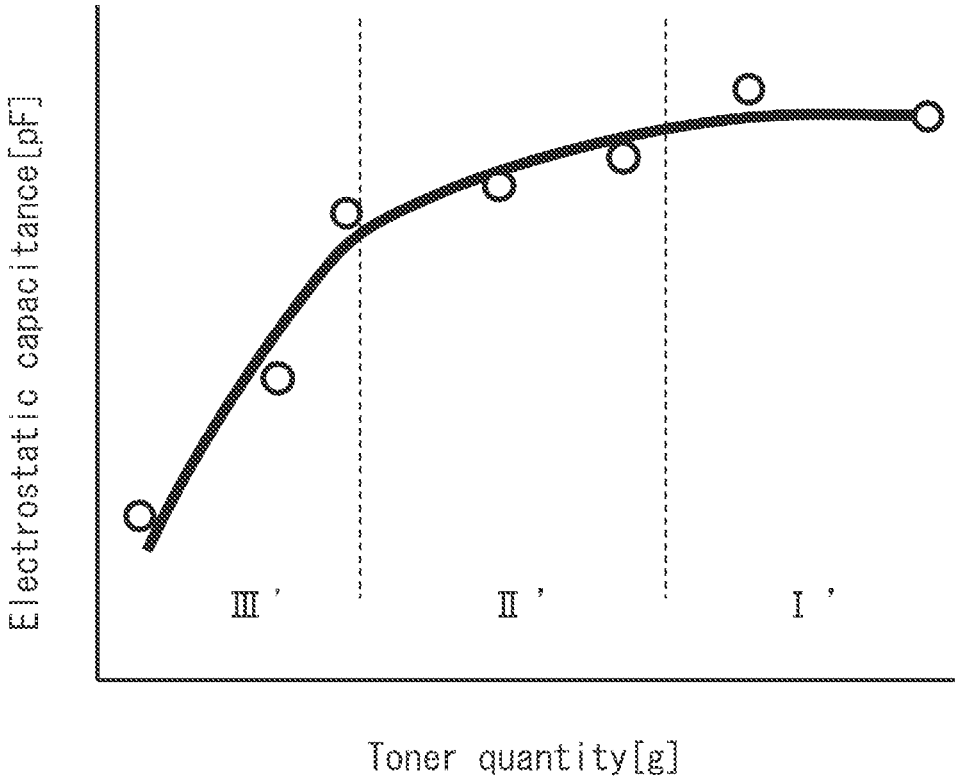
FIG. 7 is a graph illustrating electrostatic capacitance detection results according to the second exemplary embodiment.

In the narrow space 14*y*, the volume ratio between toner and air varies with the quantity of toner conveyed in the horizontal direction in the toner container 14. In other words, the relationship between the quantity of toner and the electrostatic capacitance varies as illustrated in FIG. 7 to be described below (regions I', II', III'). I': when a sufficient quantity of toner exists, toner is plentifully conveyed to the narrow portion 14*d*, whereby a state of a high toner density is formed. II': when toner is consumed due to image formation, the quantity of toner conveyed to the narrow portion 14*d* decreases, whereby the toner density in the narrow portion 14*d* decreases. III': when toner is nearly used up, the space 14*y* of the narrow portion 14*d* is filled with air alone. As toner and air have different relative dielectric constants, a change of the volume ratio between toner and air causes a change of the electrostatic capacitance. Detecting this electrostatic capacitance and determining variation thereof enables the quantity of remaining toner to be detected.

Further, the provision of the narrow portion 14*d* makes it possible to stably detect variation amount of the electrostatic capacitance, even in a thin-type horizontal-conveyance toner container, in which the quantity of toner is small and a sufficient toner density cannot be obtained. In the present exemplary embodiment, the thin-type horizontal-conveyance toner container refers to a container configured in such a manner that, at least between electrodes that detect an electrostatic capacitance, the floor surface 14*x* on which toner is conveyed has an angle equal to or smaller than an angle of repose of toner, and a toner conveyance distance at the angle of repose is greater than a vertical height of the container space.

The electrostatic capacitance is desirably detected when the toner conveyance member 10*b* is in a stationary state. For example, at an end of a print preparation operation of the image forming apparatus, or when toner conveyance is stopped after image formation is performed, an electrostatic capacitance is detected.

FIG. 7 is a graph illustrating how the quantity of toner and the detected electrostatic capacitance change according to the present exemplary embodiment. With reference to the graph of FIG. 7, regions I' to III' are described: in the region I', a sufficient quantity of toner exists; in the region II', the quantity of toner decreases, whereby the toner density decreases; and in the region III', toner is nearly used up.

In the region I', the toner density is increased between the electrodes, particularly in the narrow space 14*y*, and a stable and high electrostatic capacitance is detected. In the region II', the toner density also decreases as the quantity of toner decreases, which causes the electrostatic capacitance to gradually decrease. In the region III', a drastic decrease in the electrostatic capacitance is detected. The reason for this is such that since the distance between the electrodes gradually decreases along the toner conveyance direction, an electrostatic capacitance component in a portion where toner remains until the end is sufficiently large, and the variation thereof is also large.

From the variation of the electrostatic capacitance stably detected with respect to the quantity of toner, the quantity of toner can be detected, with a predetermined variation amount used as a threshold value.

As described above, by using the toner container and the image forming apparatus according to the present exemplary embodiment, a dead space in the toner conveyance path can be reduced as compared with conventional ones. Further, the quantity of toner can be detected with high accuracy.

Now, a third exemplary embodiment of the present invention is described.

The present exemplary embodiment is characterized in that the second electrode in the second exemplary embodiment for detecting the electrostatic capacitance is provided on the conveyance member, so as to measure an electrostatic capacitance between the upper surface of the container and the conveyance member at the narrow portion.

Figure 8:
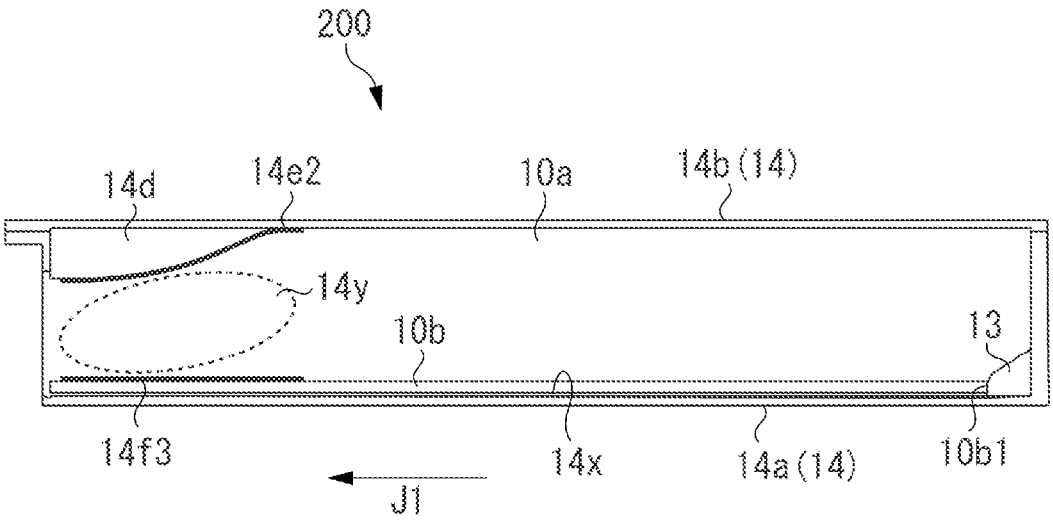
FIG. 8 is a cross-sectional view illustrating a developer quantity detection mechanism according to a third exemplary embodiment of the present invention.

FIG. 8 illustrates a configuration for detecting the quantity of toner in the toner containing portion 10*a* according to the present exemplary embodiment. In the toner remaining quantity detection mechanism according to the present exemplary embodiment, the same electrostatic capacitance method as that of the first exemplary embodiment described above is used.

In FIG. 8, the first electrode 14*e*2 is provided in the narrow portion 14*d*, as is the case with the second exemplary embodiment. As the conveyance member 10*b*, a plate-like member that is made of polyethylene terephthalate (PET) and has a thickness of 300 μm is used. Further, the second electrode 14*f*3 is provided on the surface of the conveyance member 10*b*. The second electrode 14*f*3 is formed by forming a thin film conductive pattern on a surface of the conveyance member 10*b* by sputtering vapor deposition, and hence, does not disturb the movement of the traveling wave of the conveyance member 10*b*. The second electrode 14*f*3 is provided with a conductive path (not illustrated) that is led via the fixed portion 10*b*1 of the conveyance member 10*b* to the outside of the toner containing portion 10*a*, and is connected to the controller 50 of the image forming apparatus illustrated in FIG. 1, so that an electrostatic capacitance between the two electrodes is detected.

The second electrode 10*f*3 is desirably provided on a surface of the conveyance member 10*b* on the side contacting toner (on the developer conveyance surface). Toner is directly interposed between the first electrode 14*e*2 and the second electrode 14*f*3, whereby, when an electrostatic capacitance is detected, an influence of humidity change of the conveyance member made of a resin material can be removed. Further, an influence of toner slipping into a space between the conveyance member 10*b* and the floor surface 14*x* can be removed, though such an influence is small.

As described above, by using the toner container and the image forming apparatus according to the present exemplary embodiment, a dead space in the toner conveyance path can be reduced as compared with conventional ones. Further, an influence of humidity change and the like are removed, whereby the quantity of toner can be detected with high accuracy.

Now, a fourth exemplary embodiment of the present invention is described.

Another configuration of the toner conveyance unit in the toner containing portion is described according to the present exemplary embodiment.

Figure 9A:
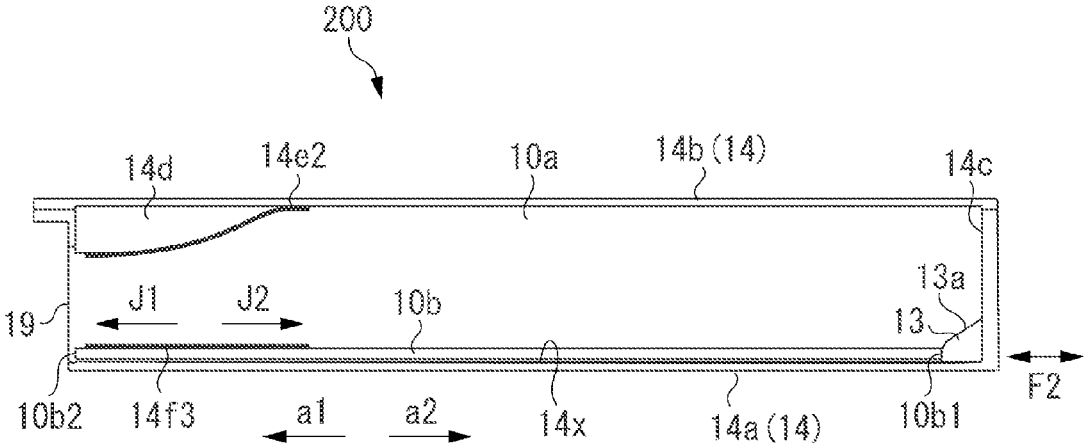
FIG. 9A is a cross-sectional view illustrating a developer conveyance mechanism.
Figure 9B:
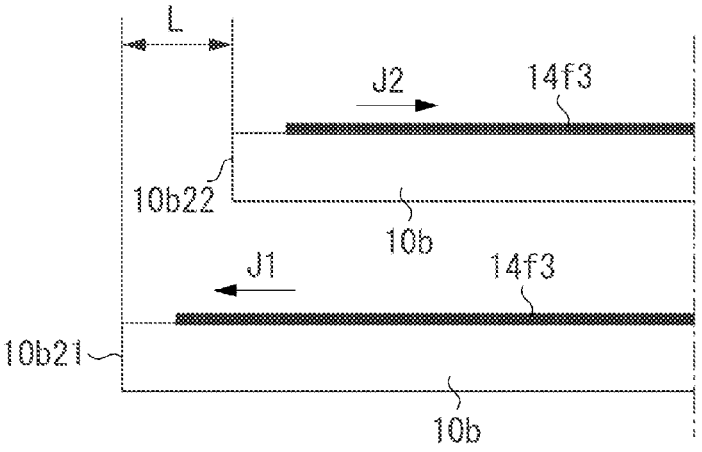
FIG. 9B is a partially enlarged cross-sectional view illustrating the developer conveyance mechanism, according to a fourth exemplary embodiment of the present invention.

FIG. 9A is a cross-sectional view illustrating a developer conveyance mechanism, and FIG. 9B is a partially enlarged cross-sectional view of FIG. 9A.

As illustrated in FIG. 9A, the vibration member 13 is a vibration imparting member that vibrates so as to give the conveyance member 10*b* a reciprocating acceleration in a conveyance surface direction F2 that is along a developer conveyance surface. When the vibration member 13 vibrates, the vibration of the vibration member 13 is transmitted via the fixed portion 10*b*1 to the conveyance member 10*b*, and the conveyance member 10*b* vibrates in the toner containing portion 10*a*.

At that time, the vibration of the vibration member 13 causes the edge portion 10*b*2 of the conveyance member 10*b* to move to a position 10*b*21 when moving largest toward the conveyance direction J1, and to a position 10*b*22 when moving largest toward a direction J2 that is opposite to the conveyance direction J1.

In the present exemplary embodiment, the vibration frequency of the vibration member 13 is set to 50 Hz, and the movement distance L of the edge portion 10*b*2, which is equivalent to a distance between the position 10*b*21 and the position 10*b*22 of the edge portion 10*b*2 of the conveyance member 10*b*, is set to about 0.6 mm.

As illustrated in FIG. 9A, the conveyance member 10*b* has the edge portion 10*b*2, which is a free edge, on the opening portion 19 side of the toner container 14, and is provided with the fixed portion 10*b*1 that is fixed to the vibration member 13 on a side opposite to the edge portion 10*b*2.

In the present exemplary embodiment, when the vibration member 13 vibrates in the conveyance surface direction F2, which crosses the thickness direction of the conveyance member 10*b*, the fixed portion 10*b*1 of the conveyance member 10*b* vibrates, and vibration is transmitted from the fixed portion 10*b*1 of the conveyance member 10*b* to the edge portion 10*b*2. At that time, the vibration of the vibration member 13 causes an acceleration a1 in the conveyance direction J1 and an acceleration a2 in the direction J2 opposite to the conveyance direction J1 to be given to the conveyance member 10*b*.

In the present exemplary embodiment, the maximum acceleration a1 in the conveyance direction J1 given by the vibration member 13 to the conveyance member 10*b* is set to be smaller than the maximum acceleration a2 in the direction J2 opposite to the conveyance direction J1 given by the vibration member 13 to the conveyance member 10*b* (acceleration setting step, a1>a2). Through such an acceleration setting step, the developer is conveyed by the conveyance member 10*b* in the conveyance direction J1 (developer conveyance step).

Through this step, a period during which toner can stay without slipping with respect to the conveyance member 10*b* that is vibrating is longer in the conveyance direction J1 than that in the direction J2 opposite to the conveyance direction J1. In other words, toner on the conveyance member 10*b* that repeats the above-described vibration is gradually conveyed in the conveyance direction J1.

By detecting the quantity of toner by using the toner conveyance configuration of the toner container described above as well as the toner remaining quantity detection configuration according to the first to third exemplary embodiments, the high-accuracy detection of the quantity of toner is achieved consequently, similar to the first to third exemplary embodiments.

OTHER EMBODIMENTS

In the exemplary embodiments described above, a process cartridge that integrally includes a photosensitive drum, a charging unit, a developing unit, and a cleaning unit as process unit that work on the photosensitive drum is used as an example process cartridge that is attachable to and detachable from the apparatus main body of the image forming apparatus. However, the present invention is not limited to this configuration. For example, the process cartridge may include, besides the photosensitive drum, any one of a charging unit, a developing unit, and a cleaning unit.

Further, in the above-described exemplary embodiments, a printer is used as an example image forming apparatus, but the present invention is not limited to this configuration. For example, the image forming apparatus may be another image forming apparatus such as a copying machine, a facsimile machine, or another image forming apparatus such as a multifunction apparatus in which these functions are combined. By applying the exemplary embodiments to the developer container used in these image forming apparatuses, similar effects can be achieved.

According to the present invention, a dead space in a developer conveyance path can be reduced as compared with conventional ones. Further, the quantity of conveyed developer can be detected with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-203555, filed Oct. 2, 2014, which is hereby incorporated by reference herein in its entirety.

What is claimed is:

1. A developer container configured to contain developer to be used for image formation, the developer container comprising:

a first electrode provided in the developer container;

a second electrode provided opposing to the first electrode configured to detect an electrostatic capacitance between the first electrode and the second electrode, to detect a quantity of the developer;

a conveyance member provided between the first electrode and the second electrode and on a bottom surface side inside the developer container, and configured to convey the developer contained in the developer container; and a vibration imparting member configured to impart vibration to the conveyance member, wherein the developer on a developer conveyance surface of the conveyance member contacting the developer is conveyed by the vibration of the conveyance member.

2. The developer container according to claim 1, wherein a narrow portion, a distance of which is narrowed in a direction orthogonal to a developer conveyance direction by the conveyance member, is provided inside the developer container, and wherein the first electrode or the second electrode is provided at the narrow portion.

3. The developer container according to claim 2, further comprising an opening for supplying the developer contained inside thereof, wherein the narrow portion is provided on a side of the opening, and wherein among faces of the narrow portion perpendicular to the developer conveyance direction, the face on the opening side has a smaller area than that of the other faces.

4. The developer container according to claim 1, wherein the first electrode is arranged on an upper surface inside the developer container, and wherein the second electrode is arranged on a floor surface inside the developer container.

5. The developer container according to claim 1, wherein a part of the conveyance member is arranged between the first electrode and the second electrode that are opposed to each other.

6. The developer container according to claim 1, wherein the first electrode is arranged on an upper surface inside the developer container, and wherein the second electrode is arranged on the developer conveyance surface of the conveyance member opposed to the first electrode.

7. The developer container according to claim 6, further comprising an opening for supplying the developer contained inside of the developer container, wherein the first electrode and the second electrode are arranged on a side of the opening on the conveyance member.

8. The developer container according to claim 1, wherein an edge of the conveyance member on an upstream side in a direction of developer conveyance by the conveyance member is fixed to the vibration imparting member, wherein the vibration imparting member gives a reciprocating acceleration in a direction orthogonal to the developer conveyance surface of the conveyance member, which contacts the developer, and wherein a traveling wave generated from the vibration imparting member as a generation source is transmitted to the conveyance member, to cause the developer on the developer conveyance surface to be conveyed in a traveling direction of the traveling wave.

9. The developer container according to claim 1, wherein an edge of the conveyance member on an upstream side in a direction of developer conveyance by the conveyance member is fixed to the vibration imparting member, wherein the vibration imparting member gives a reciprocating acceleration in a conveyance surface direction along the developer conveyance surface of the conveyance member, which contacts the developer, wherein a maximum acceleration in the developer conveyance direction given by the vibration imparting member to the conveyance member is set to be smaller than a maximum acceleration in a direction opposite to the conveyance direction given by vibration imparting member to the conveyance member, and wherein the developer on the developer conveyance surface is conveyed in the conveyance surface direction by vibration of the conveyance member along the developer conveyance surface.

10. The developer container according to claim 1, wherein the developer container is attachable to and detachable from an apparatus main body of an image forming apparatus.

11. A cartridge comprising the developer container according to claim 1 and a developer bearing member configured to bear developer.

12. A cartridge comprising the developer container according to claim 1, a developer bearing member carrying developer, and an image bearing member carrying a developer image.

13. An image forming apparatus comprising the developer container according to claim 1.

14. A developer container configured to contain developer to be used for image formation, the developer container comprising:

a first electrode provided in the developer container;

a second electrode provided so as to be opposed to the first electrode for detecting an electrostatic capacitance between the first electrode and the second electrode, to detect a quantity of the developer;

a conveyance member that includes the second electrode and is provided on n bottom surface side inside the developer container configured to convey the developer contained in the developer container; and a vibration imparting member configured to impart vibration to the conveyance member, wherein developer on a developer conveyance surface, which contact the developer, of the conveyance member is conveyed by vibration of the conveyance member.

* * * * *